US008750758B2

(12) United States Patent
Morishita

(10) Patent No.: US 8,750,758 B2
(45) Date of Patent: Jun. 10, 2014

(54) TANDEM IMAGE FORMING APPARATUS HAVING NEUTRALIZATION DEVICE PERFORMING PRE-TRANSFER NEUTRALIZATION AND POST-TRANSFER NEUTRALIZATION

(71) Applicant: Kyocera Document Solutions Inc., Osaka (JP)

(72) Inventor: Hiroki Morishita, Osaka (JP)

(73) Assignee: Kyocera Document Solutions Inc., Osaka (JP)

( * ) Notice: Subject to any disclaimer, the term of this patent is extended or adjusted under 35 U.S.C. 154(b) by 0 days.

(21) Appl. No.: 13/754,300

(22) Filed: Jan. 30, 2013

(65) Prior Publication Data

US 2013/0195507 A1 Aug. 1, 2013

(30) Foreign Application Priority Data

Jan. 31, 2012 (JP) ..... 2012-17810

(51) Int. Cl.
*G03G 21/00* (2006.01)

(52) U.S. Cl.
USPC ..... 399/128

(58) Field of Classification Search
CPC ..... G03G 21/08; G03G 21/06; G03G 15/169
USPC ..... 399/128
See application file for complete search history.

(56) References Cited

U.S. PATENT DOCUMENTS

2008/0159783 A1* 7/2008 Jung et al. ..... 399/128
2011/0249987 A1 10/2011 Ishino et al.

FOREIGN PATENT DOCUMENTS

JP 05-188828 7/1993
JP 2001-296713 10/2001
JP 2002-072602 3/2002

* cited by examiner

*Primary Examiner* — Ryan Walsh
(74) *Attorney, Agent, or Firm* — K&L Gates LLP

(57) ABSTRACT

An image forming apparatus has an intermediate transfer belt and a plurality of image forming units located along the intermediate transfer belt. Each image forming unit has a photosensitive drum, a charger that charges the photosensitive drum, a developing device that forms a toner image by attaching toner to an electrostatic latent image formed by exposure after charging, a transfer device that transfers the toner image formed on the photosensitive drum to the intermediate transfer belt, a cleaning device that removes toner remaining on the photosensitive drum, and a neutralization device that neutralizes the photosensitive drum using neutralization light. The neutralization device of at least one of the image forming units irradiates the photosensitive drum with neutralization light, irradiates the intermediate transfer belt with neutralization light, and irradiates the photosensitive drum of the adjacent image forming unit with reflected light of neutralization light from the intermediate transfer belt.

4 Claims, 6 Drawing Sheets

TANDEM IMAGE FORMING APPARATUS HAVING NEUTRALIZATION DEVICE PERFORMING PRE-TRANSFER NEUTRALIZATION AND POST-TRANSFER NEUTRALIZATION

INCORPORATION BY REFERENCE

This application is based upon, and claims the benefit of priority from, corresponding Japanese Patent Application No. 2012-17810 filed in the Japan Patent Office on Jan. 31, 2012, the entire contents of which are incorporated herein by reference.

BACKGROUND

The present disclosure relates to a tandem type image forming apparatus such as a color multifunction device.

Tandem image forming apparatuses, such as an intermediate transfer type color multifunction device, have an intermediate transfer belt looped over a driving roller and a driven roller, and a plurality of photosensitive drums for yellow, cyan, magenta, and black positioned along the surface of the intermediate transfer belt. The tandem image forming apparatuses also have a charger, a developing device, a drum cleaning device, and others for each photosensitive drum. The peripheral surfaces of the photosensitive drums are charged by the chargers and are exposed by exposure devices, and electrostatic latent images are thereby formed. Toner is attached to these electrostatic latent images by developing devices, and toner images are thereby formed. The toner images formed on the peripheral surfaces of the photosensitive drums are transferred (primarily transferred) to the surface of the intermediate transfer belt so as to be superposed on each other. Next, the toner images multiply transferred to the intermediate transfer belt are transferred (secondarily transferred) to a sheet, and a color image is thereby formed on the sheet. Toner remaining on the peripheral surfaces of the photosensitive drums after the primary transfer is removed by the drum cleaning devices.

Many of the above-described image forming apparatuses have a neutralization device for each photosensitive drum. The neutralization device removes surface potential, such as an electrostatic latent image, remaining on the peripheral surface of the photosensitive drum after a toner image is primarily transferred to the intermediate transfer belt. The neutralization device irradiates a predetermined area on the peripheral surface of the photosensitive drum from a primary transfer position to a charging position where the photosensitive drum is charged by the charger, with neutralization light from a neutralization light source, and performs neutralization (post-transfer neutralization) of the surface potential of the photosensitive drum.

However, if the surface potential remaining on the peripheral surface of the photosensitive drum cannot be sufficiently removed by the post-transfer neutralization, unevenness of surface potential remains on the peripheral surface of the photosensitive drum even after the peripheral surface of the photosensitive drum is charged by the charger. This can result in so-called image memory. For example, after a dark image is formed, a large amount of toner is not primarily transferred and remains, neutralization light is blocked and sufficient neutralization is not performed, and therefore image memory occurs.

It is effective in suppressing the occurrence of image memory to perform, before the primary transfer, neutralization (pre-transfer neutralization) by irradiating the surface of the photosensitive drum after developing with neutralization light, and to thereby facilitate the transfer of the toner image on the photosensitive drum to the intermediate transfer belt.

In order to perform pre-transfer neutralization, in addition to post-transfer neutralization, and to thereby suppress the occurrence of image memory, in addition to a device that emits neutralization light for post-transfer neutralization, a device that emits neutralization light for pre-transfer neutralization in the image forming apparatus may be provided.

In the case of a tandem image forming apparatus, a neutralization device for post-transfer neutralization and a neutralization device for pre-transfer neutralization may be provided for each of the four photosensitive drums. However, it is difficult to find space for these neutralization devices without increasing the size of the apparatus. In addition, the electric wiring to these neutralization devices is complicated, and the manufacturing cost of the image forming apparatus therefore increases.

SUMMARY

In an embodiment of the present disclosure, an image forming apparatus includes an intermediate transfer belt, and a plurality of image forming units located along the intermediate transfer belt. The image forming units each have a photosensitive drum, a charger that charges the photosensitive drum in a charging position, a developing device that forms a toner image in a developing position on the photosensitive drum by attaching toner to an electrostatic latent image formed at an exposure position after charging by the charger, a transfer device that transfers the toner image formed on the photosensitive drum to the surface of the intermediate transfer belt at a primary transfer position, a cleaning device that removes toner remaining on the photosensitive drum after the photosensitive drum passes through the primary transfer position, and a neutralization device located on the downstream side in the moving direction of the intermediate transfer belt of the photosensitive drum and neutralizing the photosensitive drum using neutralization light. In at least one of the plurality of image forming units other than the most downstream one of the plurality of image forming units, the neutralization device irradiates the photosensitive drum of at least one of the plurality of image forming units with the neutralization light between the transfer position and the charging position, irradiates the surface of the intermediate transfer belt with the neutralization light, and irradiates the photosensitive drum of one of the plurality of image forming units adjacent to the downstream side of at least one of the plurality of image forming units with reflected light of the neutralization light from the surface of the intermediate transfer belt between the developing position and the transfer position.

Additional features and advantages are described herein, and will be apparent from the following Detailed Description and the figures.

DETAILED DESCRIPTION

Figure 1:
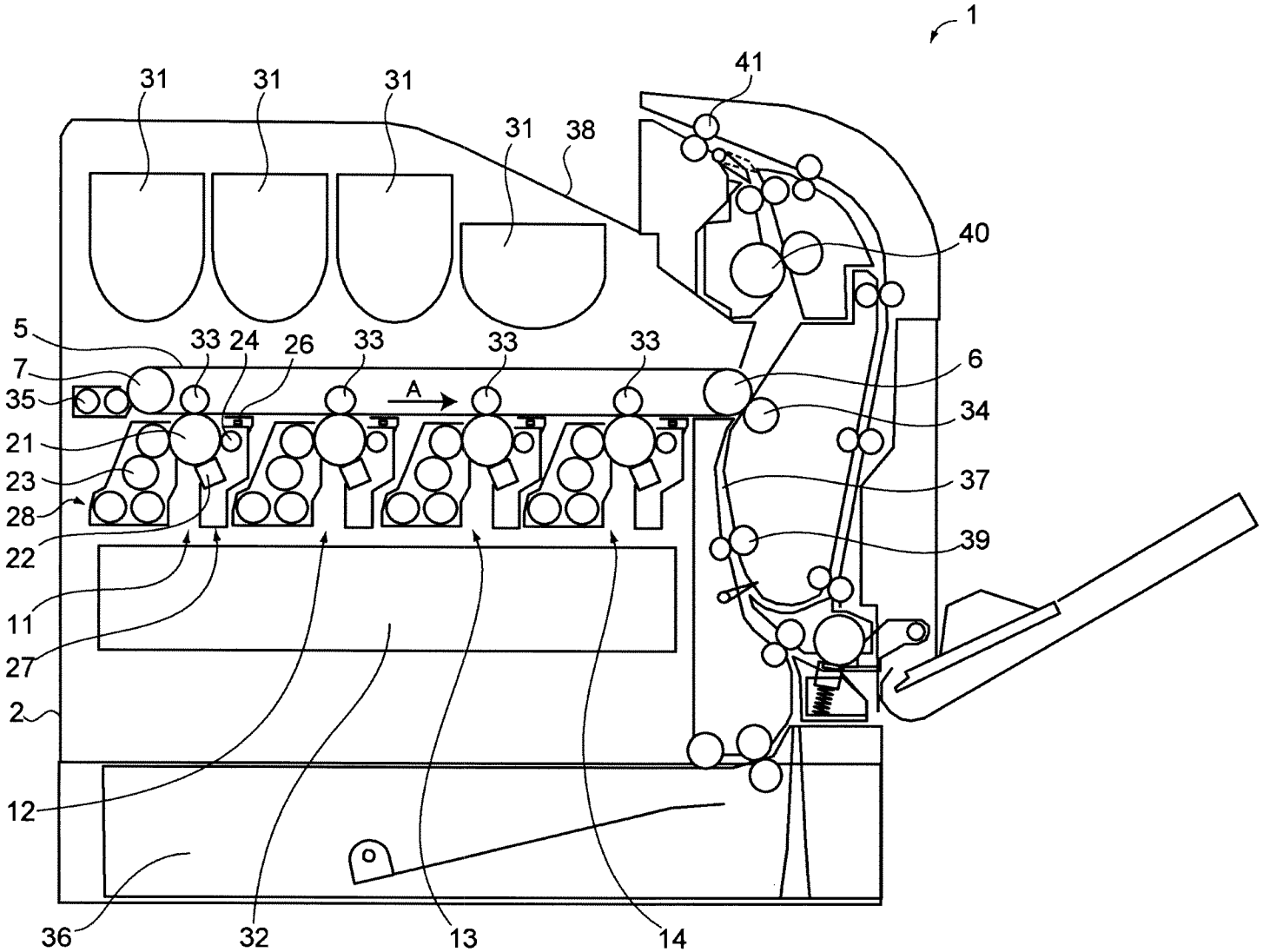
FIG. 1 is an explanatory view showing the internal structure of an image forming apparatus according to an embodiment of the present disclosure.

An embodiment of the present disclosure will be described with reference to the drawings. FIG. 1 shows an image forming apparatus according to an embodiment of the present disclosure. In FIG. 1, the image forming apparatus according to the embodiment is a tandem image forming apparatus using an intermediate transfer method, is capable of forming a color image, and is a multifunction device having the functions of a printer, a copying machine, a fax machine, and others.

The image forming apparatus 1 comprises, in a case 2 thereof, an intermediate transfer belt 5, and four image forming units 11, 12, 13, and 14 for yellow, cyan, magenta, and black respectively. The intermediate transfer belt 5 is an endless belt looped over a driving roller 6 and a driven roller 7, and is moved in the direction of arrow A illustrated in FIG. 1 by rotationally driving the driving roller 6. The intermediate transfer belt 5 has a three-layer structure comprising a 0.3 mm thick elastic layer of nitrile rubber (NBR rubber) on a 0.1 mm thick base material layer of polyvinylidene difluoride (PVDF) resin, and a 10 μm thick coat layer of polytetrafluoroethylene (PTFE) on the surface of the elastic layer. The surface of the intermediate transfer belt 5 is originally whitish light brown expressed as (209, 182, 149) in RGB notation. At an early stage of using the intermediate transfer belt 5, adhesion of external additive of toner, such as silica, makes the surface of the intermediate transfer belt 5 whiter and less lustrous and therefore diffusively reflective. The four image forming units 11, 12, 13, and 14 are located along the intermediate transfer belt 5, from the upstream side toward the downstream side in the moving direction of the intermediate transfer belt 5, in the order of yellow, cyan, magenta, and black at regular intervals.

The image forming units 11, 12, 13, and 14 each have a photosensitive drum 21, a charger 22 that charges the photosensitive drum 21, a developing device 23 that forms a toner image by attaching toner to an electrostatic latent image formed on the peripheral surface of the photosensitive drum 21 by exposing the charged photosensitive drum 21 with an exposure device 32, a drum cleaning device 24 that removes toner remaining on the peripheral surface of the photosensitive drum 21 after the toner image is transferred to the surface of the intermediate transfer belt 5, and a neutralization device 26 that neutralizes the photosensitive drum 21. In each of the image forming units 11, 12, 13, and 14, the charger 22, the developing device 23, and the drum cleaning device 24 are positioned around the photosensitive drum 21 (in this order in the rotation direction of the photosensitive drum 21 (clockwise direction in FIG. 1)). The toner image formed on the peripheral surface of the photosensitive drum 21 is primarily transferred to the surface of the intermediate transfer belt 5 between the developing device 23 and the drum cleaning device 24.

The image forming units 11, 12, 13, and 14 each have a drum unit 27 and a developing unit 28. The drum unit 27 includes the photosensitive drum 21, the charger 22, the drum cleaning device 24, and the neutralization device 26 (see FIG. 2 and FIG. 4). The developing unit 28 includes the developing device 23. For example, in the image forming apparatus 1, the drum unit 27 and the developing unit 28 are installed, positioned, and fixed in each of the four image forming units 11, 12, 13, and 14.

The image forming apparatus 1 also has toner containers 31 of respective colors, an exposure device 32 that exposes the peripheral surfaces of the charged photosensitive drums 21 and thereby forms electrostatic latent images, primary transfer rollers 33 located so as to face the photosensitive drums 21 with the intermediate transfer belt 5 therebetween, a secondary transfer roller 34 disposed so as to face the driving roller 6 with a sheet conveying path 37 therebetween, and a belt cleaning device 35 located so as to face the driven roller 7 and cleaning the intermediate transfer belt 5. The image forming apparatus 1 also has a sheet cassette 36 storing sheet, a sheet conveying path 37 conveying sheet, and a sheet output tray 38 onto which a sheet on which image is printed is ejected. A conveying roller pair 39, a fixing device 40, an ejection roller pair 41, and others are provided along the sheet conveying path 37.

In the image forming apparatus 1 having the above configuration, the driving roller 6 rotates, the intermediate transfer belt 5 moves in the direction of arrow A, and the photosensitive drums 21 of the image forming units 11, 12, 13, and 14 rotate. The photosensitive drums 21 of the image forming units 11, 12, 13, and 14 are charged by chargers 22 and are exposed by the exposure device 32, and electrostatic latent images corresponding to an image to be formed (original image) are formed on the peripheral surfaces of the photosensitive drums 21. Next, toner images are formed on the electrostatic latent images formed on the peripheral surfaces of the photosensitive drums 21 by the developing devices 23, and then these toner images are primarily transferred onto the surface of the intermediate transfer belt 5. Thereafter, toner remaining on the peripheral surfaces of the photosensitive drums 21 is removed by the drum cleaning devices 24. The toner images of respective colors formed on the photosensitive drums 21 of the image forming units 11, 12, 13, and 14 are primarily transferred onto the surface of the moving intermediate transfer belt 5 so as to be superposed on each other. Thus, when the primary transfer of toner images of respective colors to the intermediate transfer belt 5 is completed, a color toner image corresponding to the original image is formed on the surface of the intermediate transfer belt 5. The color toner image formed in this way is secondarily transferred to a sheet fed from the sheet cassette 36 or the like through the sheet conveying path 37. After fixing is performed by the fixing device 40, the sheet is ejected onto the sheet output tray 38.

Figure 2:
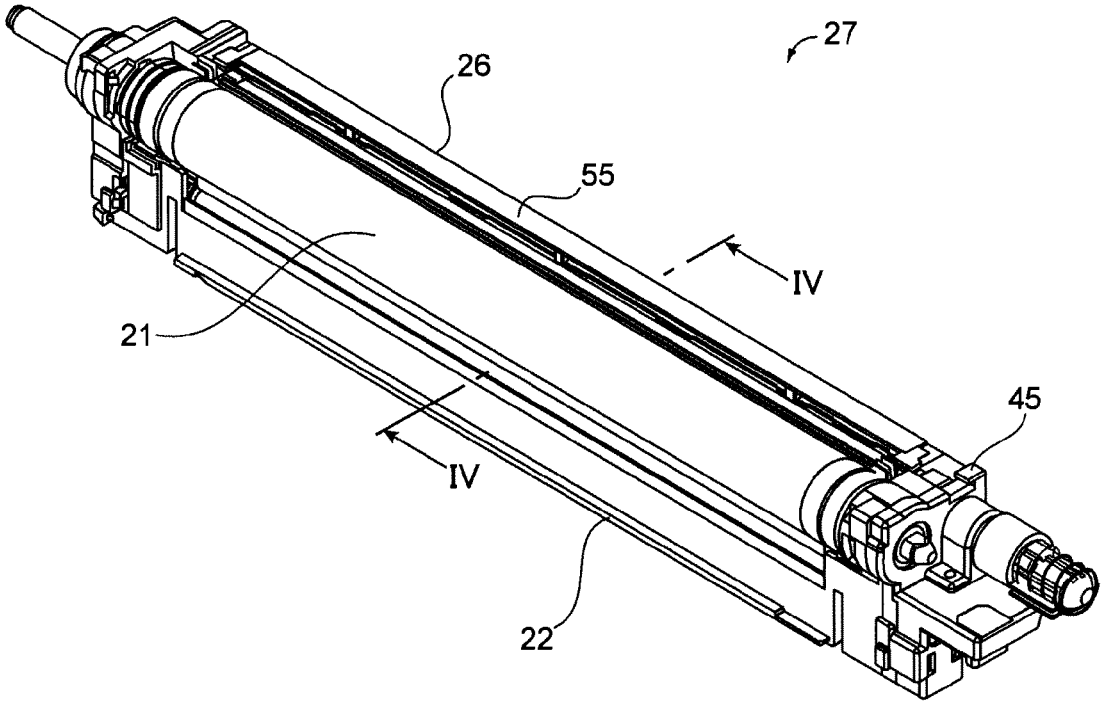
FIG. 2 is a perspective view showing a drum unit in the image forming apparatus according to an embodiment of the present disclosure.
Figure 3:
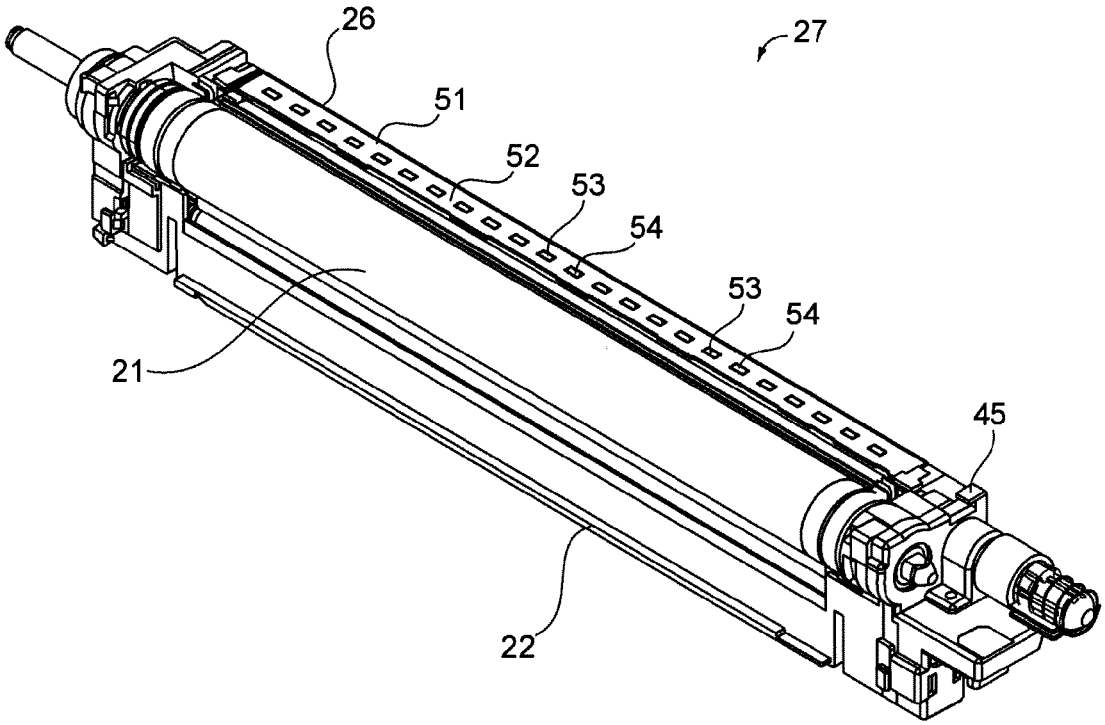
FIG. 3 is a perspective view showing the drum unit with the cover of the neutralization device removed.
Figure 4:
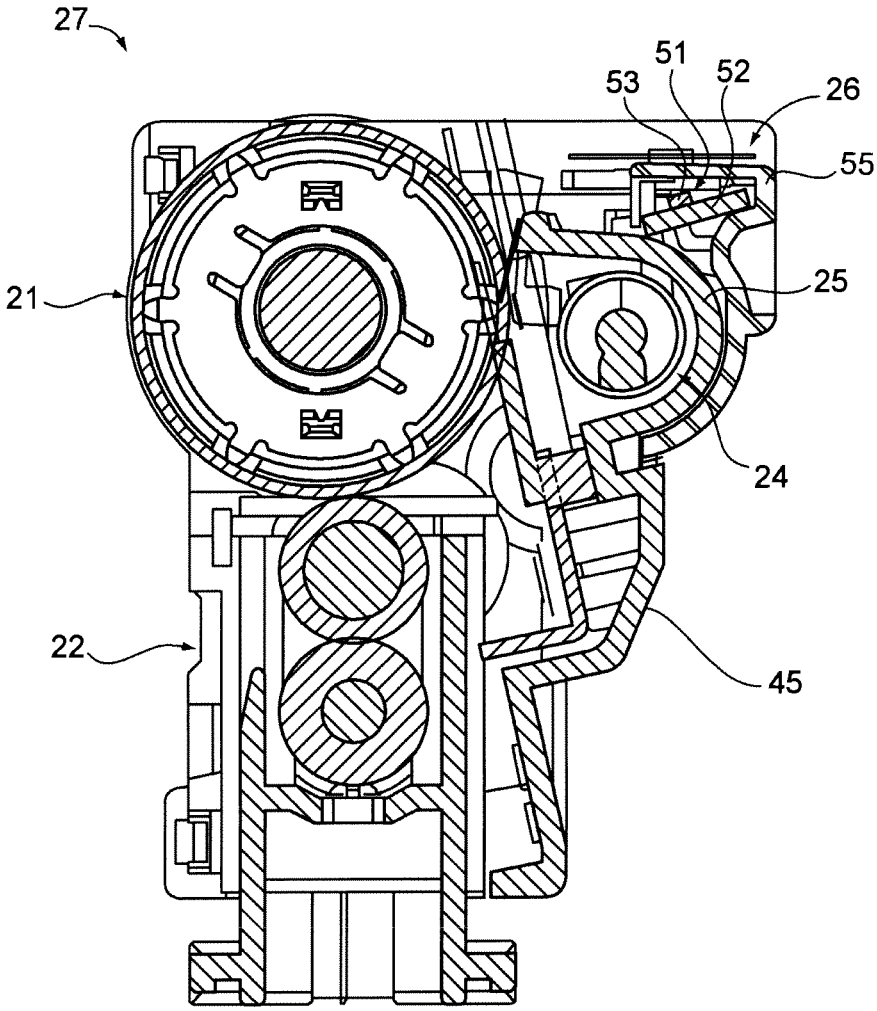
FIG. 4 is a sectional view taken along line IV-IV of FIG. 2.
Figure 5:
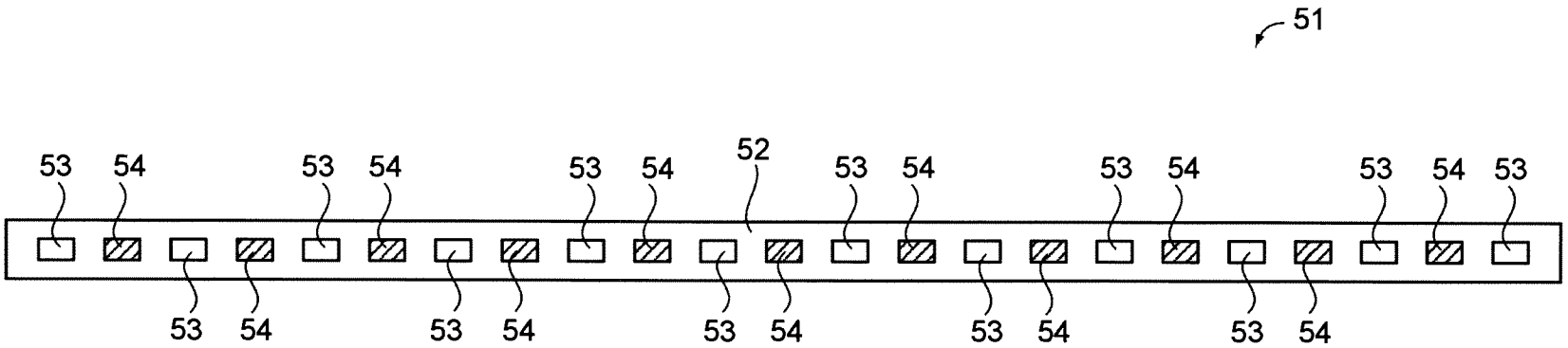
FIG. 5 is an explanatory view showing a light source unit of the neutralization device in the image forming apparatus according to an embodiment of the present disclosure.

FIG. 2 shows the drum unit 27 of the image forming unit 11. FIG. 3 shows the neutralization device 26 provided in the drum unit 27 in FIG. 2 with the cover 55 removed. FIG. 4 is a sectional view of the drum unit 27 taken along line IV-IV of FIG. 2. FIG. 5 shows a light source unit provided in the neutralization device 26 of the image forming unit 11.

The drum unit 27 of the image forming unit 11 has, as shown in FIG. 2, an elongated cylindrical photosensitive drum 21, and a mount portion 45 rotatably supporting both ends of the photosensitive drum 21. The drum unit 27 also has, as shown in FIG. 4, a charger 22 attached to the mount portion 45 so as to be located under the photosensitive drum 21, and a drum cleaning device 24 attached to the mount portion 45 so as to be located on the right side of the photosensitive drum 21.

In the drum unit 27, a neutralization device 26 is attached to an outer shell 25 of the drum cleaning device 24. In FIG. 4, the neutralization device 26 is located on the right side of the photosensitive drum 21 and on the upper right side of the drum cleaning device 24. That is to say, when the drum unit 27 and the developing unit 28 are installed in the case 2 of the image forming apparatus 1, as shown in FIG. 1, the drum cleaning device 24 located on the right side of the photosensitive drum 21 in FIG. 4 is positioned on the downstream side, in the moving direction of the intermediate transfer belt 5, of the photosensitive drum 21 of the image forming unit 11 as shown in FIG. 1. The neutralization device 26 located on the right side of the photosensitive drum 21 and on the upper right side of the drum cleaning device 24 in FIG. 4 is positioned, as shown in FIG. 1, on the downstream side, in the moving direction of the intermediate transfer belt 5, of the photosensitive drum 21 of the image forming unit 11, and closer to the intermediate transfer belt 5 than the drum cleaning device 24.

As shown in FIG. 2 or FIG. 3, the neutralization device 26 has a light source unit 51 and a cover 55. The light source unit 51 has, as shown in FIG. 5, a substrate 52, a plurality of light-emitting diodes for post-transfer neutralization 53 (first light sources) attached on the substrate 52, a plurality of light-emitting diodes for pre-transfer neutralization 54 (second light sources) attached on the substrate 52, and a drive control circuit (not shown) formed on the substrate 52 and controlling the light emission and others of the light-emitting diodes 53 and 54.

In this embodiment, the substrate 52 is a flat plate-like member formed in an elongated rectangular shape, has substantially the same length as the length in the axial direction of the photosensitive drum 21, positioned parallel to the axial direction of the photosensitive drum 21, and is attached to part of the outer shell 25 of the drum cleaning device 24 or the cover 55. The light-emitting diodes for post-transfer neutralization 53 and the light-emitting diodes for pre-transfer neutralization 54 are arranged in a line on one side of the substrate 52 parallel to the axial direction of the photosensitive drum 21. The light-emitting diodes for post-transfer neutralization 53 and the light-emitting diodes for pre-transfer neutralization 54 are alternately positioned. The direction of the light-emitting diodes for post-transfer neutralization 53 is set such that the photosensitive drum 21 of the image forming unit 11 is irradiated with light (neutralization light L1) emitted from the light-emitting diodes 53 between a primary transfer position P3 and a cleaning position P4 as described later. The direction of the light-emitting diodes for pre-transfer neutralization 54 is set such that the surface of the intermediate transfer belt 5 is irradiated with light (neutralization light L2) emitted from the light-emitting diodes 54, and the photosensitive drum 21 of the image forming unit 12 adjacent to the downstream side of the image forming unit 11 is irradiated with reflected light L3 from the surface of the intermediate transfer belt 5 between a developing position P2 and a primary transfer position P3 as described later (see FIG. 6).

The cover 55 is attached to the outer shell 25 of the drum cleaning device 24 as shown in FIG. 4, and covers the substrate 52 of the light source unit 51 throughout its length as shown in FIG. 2. The cover 55 covers the upper side and right side of the light source unit 51 as shown in FIG. 4. However, the cover 55 does not cover the left side of the light source unit 51 in FIG. 4. That is to say, when the drum unit 27 and the developing unit 28 are installed in the case 2 of the image forming apparatus 1 as shown in FIG. 1, the cover 55 covers part of the light source unit 51 facing the intermediate transfer belt 5 and part of the light source unit 51 facing downstream, but does not cover part of the light source unit 51 facing the photosensitive drum 21 of the image forming unit 11. The cover 55 is light transmissive. For example, the cover 55 is formed of a transparent or translucent resin material.

The cover 55 blocks the movement of objects (for example, toner) between the light source unit 51 and the intermediate transfer belt 5, and transmits light emitted from the light-emitting diodes for pre-transfer neutralization 54 and irradiating the surface of the intermediate transfer belt 5. Thus, pre-transfer neutralization, which will be described later, can be performed and the light source unit 51 can be protected. For example, contamination of the light source unit 51 by toner can be prevented. Since part of the light source unit 51 facing the photosensitive drum 21 of the image forming unit 11 is not covered by the cover 55, light emitted from the light-emitting diodes for post-transfer neutralization 53 can travel, without being blocked, toward part of the photosensitive drum 21 of the image forming unit 11 between the primary transfer position P3 and the cleaning position P4.

The structure of the drum unit 27 and the arrangement and structure of the neutralization device 26 in the image forming units 12 and 13 are the same as the structure of the drum unit 27 and the arrangement and structure of the neutralization device 26 in the image forming unit 11 described above. The structure of the drum unit 27 and the arrangement of the neutralization device 26 in the image forming unit 14 located in the most downstream position are the same as the structure of the drum unit 27 and the arrangement of the neutralization device 26 in the image forming unit 11 described above. However, the neutralization device 26 in the image forming unit 14 has light-emitting diodes for post-transfer neutralization 53 and no light-emitting diodes for pre-transfer neutralization 54.

Figure 6:
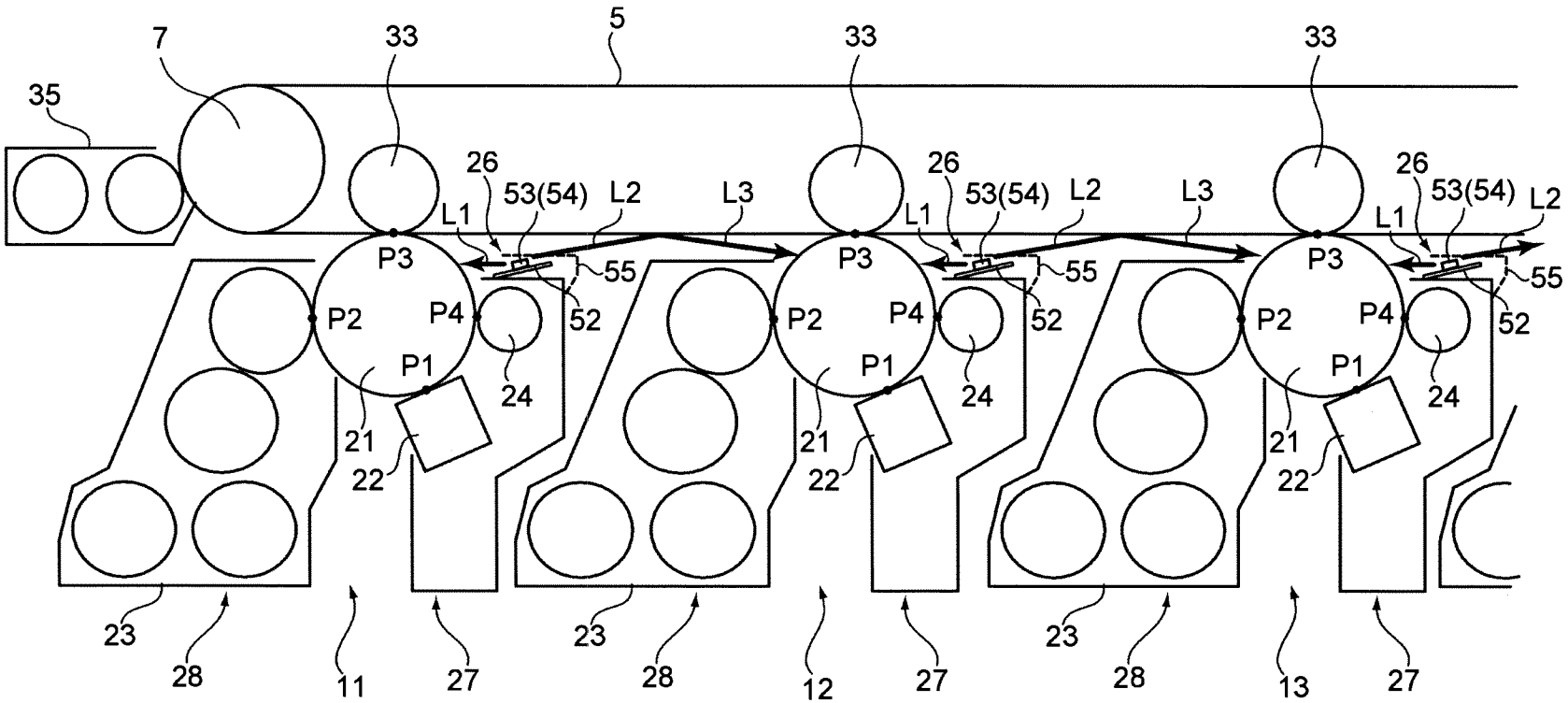
FIG. 6 is an explanatory view showing the operation of neutralization devices in the image forming apparatus according to an embodiment of the present disclosure.

FIG. 6 shows the post-transfer neutralization and pre-transfer neutralization in the image forming units 11, 12, and 13. The post-transfer neutralization and pre-transfer neutralization in the image forming units 11, 12, and 13 will be described with reference to FIG. 6. For purposes of illustration, in each of the image forming units 11, 12, and 13, the position where the photosensitive drum 21 is charged by the charger 22 will be referred to as charging position P1, the position where a toner image is formed on the peripheral surface of the photosensitive drum 21 by the developing device 23 will be referred to as developing position P2, the position where the toner image is primarily transferred from the peripheral surface of the photosensitive drum 21 to the surface of the intermediate transfer belt 5 will be referred to as primary transfer position P3, and the position where toner remaining on the peripheral surface of the photosensitive drum 21 is removed by the drum cleaning device 24 will be referred to as cleaning position P4.

First, post-transfer neutralization and pre-transfer neutralization performed by the neutralization device 26 provided in the image forming unit 11 will be described. As shown in FIG. 6, in the neutralization device 26 of the image forming unit 11, the light-emitting diodes for post-transfer neutralization 53 perform the post-transfer neutralization of the photosensitive drum 21 provided in the image forming unit 11 using neutralization light L1. That is to say, the photosensitive drum 21 provided in the image forming unit 11 is directly irradiated with neutralization light L1 emitted from the light-emitting diodes 53 between the primary transfer position P3 and the cleaning position P4. Surface potential remaining on the photosensitive drum 21 after the primary transfer is thereby removed.

The distance between each of the light-emitting diodes for post-transfer neutralization 53 and the photosensitive drum 21 irradiated with neutralization light L1 emitted from the light-emitting diodes 53 is relatively short. There is nothing that blocks neutralization light L1 between each of the light-emitting diodes 53 and the photosensitive drum 21. Therefore, the intensity of neutralization light L1 when neutralization light L1 reaches the peripheral surface of the photosensitive drum 21 is greater than that of reflected light L3 to be described later, and is appropriate for performing the post-transfer neutralization of the photosensitive drum 21.

On the other hand, in the neutralization device 26 of the image forming unit 11, the light-emitting diodes for pre-transfer neutralization 54 perform the post-transfer neutralization of the photosensitive drum 21 provided in the image forming unit 12 adjacent to the downstream side of the image forming unit 11 using the reflected light L3 of the neutralization light L2. That is to say, the neutralization light L2 emitted from the light-emitting diodes 54 is transmitted by the light-transmissive cover 55, and the surface of the intermediate transfer belt 5 moving between the image forming unit 11 and the image forming unit 12 adjacent to the downstream side of the image forming unit 11 is irradiated with the neutralization light L2. The neutralization light L2 is reflected on the surface of the intermediate transfer belt 5, and the photosensitive drum 21 provided in the image forming unit 12 adjacent to the downstream side of the image forming unit 11 is irradiated with the reflected light L3 between the developing position P2 and the primary transfer position P3. By such indirect irradiation with the neutralization light L2, neutralization of the photosensitive drum 21 of the image forming unit 12 before the primary transfer is performed.

The distance between each of the light-emitting diodes for pre-transfer neutralization 54 and the photosensitive drum 21 irradiated with the reflected light L3 of the neutralization light L2 emitted from the light-emitting diodes 54 is relatively long. The neutralization light L2 emitted from the light-emitting diodes 54 is transmitted by the cover 55. Although the cover 55 is light-transmissive, it partially reflects or diffuses light. Therefore, the neutralization light L2 is partially reflected or diffused when transmitted by the cover 55. The neutralization light L2 is reflected on the surface of the intermediate transfer belt 5, and the reflected light L3 reaches the photosensitive drum 21 of the image forming unit 12. Depending on the reflectance of the surface of the intermediate transfer belt 5, the neutralization light L2 is partially absorbed or diffused. Therefore, the intensity of the reflected light L3 when the reflected light L3 reaches the peripheral surface of the photosensitive drum 21 of the image forming unit 12 is less than that of the above-described neutralization light L1, and is appropriate for performing the pre-transfer neutralization of the photosensitive drum 21 of the image forming unit 12.

Also in the neutralization devices 26 provided in the image forming units 12 and 13, the same post-transfer neutralization and pre-transfer neutralization as those described above are performed. In the neutralization device 26 provided in the image forming unit 14 located in the most downstream position, only the same post-transfer neutralization as that described above is performed.

As described above, in an embodiment of the image forming apparatus 1, the post-transfer neutralization in the image forming unit 11 and the pre-transfer neutralization in the image forming unit 12 can be performed by the neutralization device 26 provided in the image forming unit 11, the post-transfer neutralization in the image forming unit 12 and the pre-transfer neutralization in the image forming unit 13 can be performed by the neutralization device 26 provided in the image forming unit 12, and the post-transfer neutralization in the image forming unit 13 and the pre-transfer neutralization in the image forming unit 14 can be performed by the neutralization device 26 provided in the image forming unit 13. As described above, in an embodiment of the image forming apparatus 1, the occurrence of image memory can be suppressed by providing each of the image forming units 11, 12, 13, and 14 with a neutralization device 26. Thus, spaces for the neutralization devices 26 can be easily provided in the image forming apparatus 1, the electric wiring to the neutralization device 26 is not complicated, and an increase in the manufacturing cost of the image forming apparatus 1 can be suppressed.

According to the image forming apparatus 1, the neutralization devices 26 are attached to the outer shells 25 of the drum cleaning devices 24, and new structures for supporting the neutralization devices 26 need not be provided. Therefore, new members and spaces for supporting the neutralization devices 26 need not be provided. Maintenance of the neutralization devices 26 can be easily performed by removing the drum units 27 from the image forming apparatus 1.

In the above embodiment, in the neutralization devices 26 of the image forming units 11, 12, and 13, for example, a total of twenty-odd light-emitting diodes for post-transfer neutralization 53 and light-emitting diodes for pre-transfer neutralization 54 are alternately positioned in a line. However, the present disclosure is not so limited. The number of the light-emitting diodes 53 and 54 may be reduced or increased. The intensity of light used for post-transfer neutralization is preferably greater than the intensity of light used for pre-transfer neutralization, and therefore the number of the light-emitting diodes for post-transfer neutralization 53 may be increased in order to obtain a great intensity, and the number of the light-emitting diodes for pre-transfer neutralization 54 may be reduced in order to suppress the intensity. For example, the ratio of the number of the light-emitting diodes for post-transfer neutralization 53 to the number of the light-emitting diodes for pre-transfer neutralization 54 may be not 1:1 but 2:1, 3:1, or the like. In this case, it is desirable that the light-emitting diodes for post-transfer neutralization 53 and the light-emitting diodes for pre-transfer neutralization 54 be arranged in a line on the substrate 52 in such a manner that two (or three) light-emitting diodes 53 are placed successively, then one light-emitting diode 54 is placed, then two (or three) light-emitting diodes 53 are placed successively, then one light-emitting diode 54 is placed. The photosensitive drums 21 can be irradiated uniformly throughout their lengths with the neutralization light for post-transfer neutralization and the neutralization light for pre-transfer neutralization.

In the above embodiment, the entire cover 55 of each neutralization device 26 is formed of a light-transmissive material. However, the present disclosure is not so limited. Parts of the cover 55 facing the light-emitting diodes 54 may be formed of a light-transmissive material, or the cover 55 may have openings and may be formed of an opaque material. Also in this case, the surface of the intermediate transfer belt 5 can be irradiated with the neutralization light emitted from the light-emitting diodes for pre-transfer neutralization 54, and the pre-transfer neutralization in the adjacent image forming unit can be performed using the reflected light.

Figure 7:
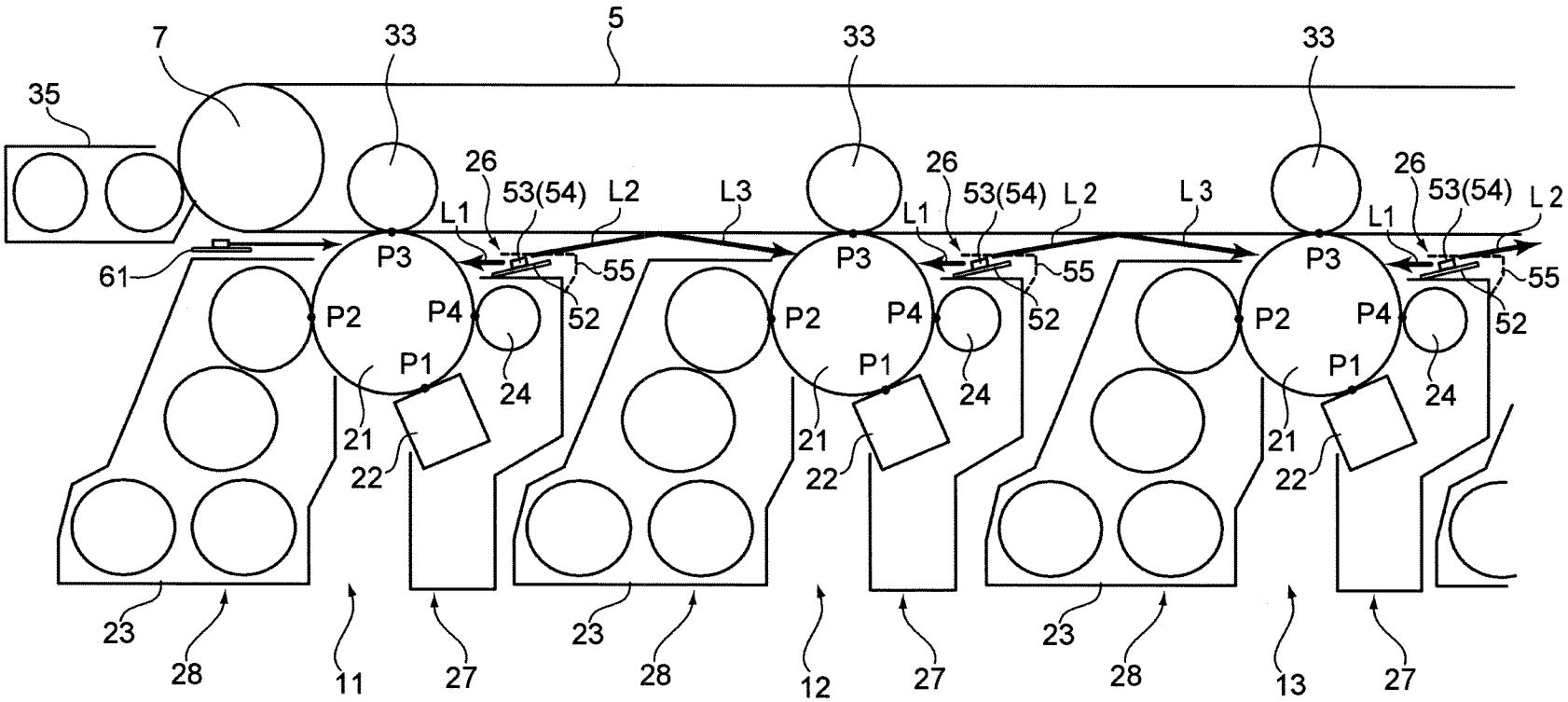
FIG. 7 is an explanatory view showing part of an image forming apparatus according to another embodiment of the present disclosure.

In the above embodiment, as shown in FIG. 6, pre-transfer neutralization is not performed in the image forming unit 11 located in the most upstream position. The color of the toner image formed on the peripheral surface of the photosensitive drum 21 of the image forming unit 11 is yellow. Therefore, if an image memory is formed, the image memory is less noticeable compared to the other colors, and has relatively less impact on the quality of the final image. Therefore, by not performing pre-transfer neutralization in the image forming unit 11, the number of neutralization devices 26 and places for neutralization devices 26 can be reduced while substantially securing the image quality. However, in order to perform pre-transfer neutralization in the image forming unit 11, as shown in FIG. 7, a neutralization device 61 may be added on the upstream side of the image forming unit 11. The neutralization device 61 irradiates the photosensitive drum 21 provided in the image forming unit 11 between the developing position P2 and the primary transfer position P3, and performs neutralization before primary transfer of the photosensitive drum 21 of the image forming unit 11. Thus, the occurrence of image memory in the image forming unit 11 can be suppressed, and the image quality can be further improved.

In the above embodiment, the photosensitive drums 21 are irradiated with neutralization light emitted from the light-emitting diodes 53 in the neutralization devices 26 of the image forming units 11, 12, 13, and 14 between the primary transfer position P3 and the cleaning position P4, and thereby the post-transfer neutralization of the photosensitive drums 21 is performed. However, the present disclosure is not so limited. The post-transfer neutralization of the photosensitive drums 21 may be performed by irradiating the photosensitive drums 21 with neutralization light L1 emitted from the light-emitting diodes 53 in the neutralization devices 26 of the image forming units 11, 12, 13, and 14 between the primary transfer position P3 and the charging position P1.

In the above embodiment, the image forming apparatus of the present disclosure is applied to a multifunction device. However, the present disclosure is not so limited. The image forming apparatus of the present disclosure can also be applied to a printer, a copying machine, a fax machine, and the like.

It should be understood that various changes and modifications to the presently preferred embodiments described herein will be apparent to those skilled in the art. Such changes and modifications can be made without departing from the spirit and scope of the present subject matter and without diminishing its intended advantages. It is therefore intended that such changes and modifications be covered by the appended claims.

The invention is claimed as follows:

1. An image forming apparatus comprising:

an intermediate transfer belt;

a plurality of image forming units located along the intermediate transfer belt;

the image forming units each have a photosensitive drum, a charger that charges the photosensitive drum in a charging position, a developing device that forms a toner image in a developing position on the photosensitive drum by attaching toner to an electrostatic latent image formed in an exposure position after the charging by the charger, a transfer device that transfers the toner image formed on the photosensitive drum to the surface of the intermediate transfer belt in a primary transfer position, a cleaning device that removes toner remaining on the photosensitive drum after the photosensitive drum passes through the primary transfer position, and a neutralization device located on the downstream side in the moving direction of the intermediate transfer belt of the photosensitive drum and neutralizing the photosensitive drum using neutralization light; and in at least one of the plurality of image forming units, other than the most downstream one of the plurality of image forming units, the neutralization device irradiates the photosensitive drum with the neutralization light between the transfer position and the charging position, irradiates the surface of the intermediate transfer belt with the neutralization light, and irradiates the photosensitive drum of one of the plurality of image forming units adjacent to the downstream side of the at least one of the plurality of image forming units with reflected light of the neutralization light from the surface of the intermediate transfer belt between the developing position and the transfer position, wherein, in the at least one of the plurality of image forming units, the neutralization device has first light sources that emit the neutralization light with which the photosensitive drum of the at least one of the plurality of image forming units is irradiated between the transfer position and the charging position, and second light sources that emit the neutralization light with which the surface of the intermediate transfer belt moving between the at least one of the plurality of image forming units and an image forming unit adjacent to the downstream side of the at least one of the plurality of image forming units is irradiated.

2. The image forming apparatus according to claim 1, wherein in the at least one of the plurality of image forming units, the neutralization device has a light-transmissive cover covering at least part of the first light sources and the second light sources, which face the intermediate transfer belt.

3. The image forming apparatus according to claim 1, wherein the image forming units each have a drum unit including the photosensitive drum, the charger, and the drum cleaning device, and a developing unit including the developing device, and the neutralization device is attached to an outer shell of the drum cleaning device, and is included in the drum unit.

4. The image forming apparatus according to claim 1, wherein the neutralization device has a flat plate-like substrate, and the first light sources and the second light sources are located at intervals in a predetermined direction on one side of the flat plate-like substrate.

* * * * *